US012629560B2

(12) United States Patent
Root et al.

(10) Patent No.: US 12,629,560 B2
(45) **Date of Patent: *May 19, 2026**

(54) SYSTEM AND METHOD FOR A GOLF SUPER TAG MULTIFUNCTION GOLF SWING CAPTURE AND ANALYSIS DEVICE

(71) Applicants: Richard Root, Ridgeland, MS (US); Richard C. Edmonson, Ridgeland, MS (US)

(72) Inventors: Richard Root, Ridgeland, MS (US); Richard C. Edmonson, Ridgeland, MS (US)

(73) Assignee: Skyhawke Technologies LLC, Ridgeland, MS (US)

( * ) Notice: Subject to any disclaimer, the term of this patent is extended or adjusted under 35 U.S.C. 154(b) by 243 days.

This patent is subject to a terminal disclaimer.

(21) Appl. No.: 17/986,836

(22) Filed: Nov. 14, 2022

(65) Prior Publication Data

US 2023/0173341 A1 Jun. 8, 2023

Related U.S. Application Data

(60) Provisional application No. 63/279,576, filed on Nov. 15, 2021.

(51) Int. Cl.
*A63B 24/00* (2006.01)

(52) U.S. Cl.
CPC ..... *A63B 24/0003* (2013.01); *A63B 24/0084* (2013.01); *A63B 2220/40* (2013.01); *A63B 2220/53* (2013.01); *A63B 2220/833* (2013.01)

(58) Field of Classification Search
CPC ..... A63B 24/0003; A63B 24/0084; A63B 2220/40; A63B 2220/53; A63B 2220/833
See application file for complete search history.

(56) References Cited

U.S. PATENT DOCUMENTS

2013/0144411 A1* 6/2013 Savarese ..... A63B 55/00 700/91
2013/0184039 A1* 7/2013 Steir ..... A63F 13/828 463/1
2016/0271445 A1* 9/2016 Kolloff ..... G06V 40/23
2017/0157482 A1* 6/2017 DeCarlo ..... A63B 63/083
2018/0200605 A1* 7/2018 Syed ..... A63B 71/0669
(Continued)

*Primary Examiner* — Malina D. Blaise
(74) *Attorney, Agent, or Firm* — Olivo IP Law Group P.C.; John W. Olivo, Jr.

(57) ABSTRACT

The present invention is a Golf Super Tag Multifunction Golf Swing Capture and Analysis device comprised of a printed circuit board mounted in a case attached to the end of the club grip or mounted along the club shaft containing sensors and electronic components. The sensor data associated with the golf club swing is processed by the microcontroller firmware that analyzes the physics of the golf swing to determine the various characteristics of the golf swing such as swing plane, club face orientation, club head speed, point of ball impact, etc. This data can be stored in onboard memory and/or relayed via Bluetooth Low Energy or other communication protocols for storage, further application processing and/or relay to web-based systems. The firmware is comprised of code that runs on the microcontroller to handle the microcontroller startup, wake up, power management, sensor control and sensor data, as well as Bluetooth (or other communication protocols).

29 Claims, 9 Drawing Sheets

(56) References Cited

U.S. PATENT DOCUMENTS

| | | | | |
|---|---|---|---|---|
| 2018/0249944 | A1* | 9/2018 | Poutiatine | G01J 1/429 |
| 2018/0326284 | A1* | 11/2018 | Mariappan | A63B 60/46 |
| 2020/0128902 | A1* | 4/2020 | Brown | A42B 3/30 |
| 2020/0387817 | A1* | 12/2020 | Kurtz | G06F 18/251 |
| 2021/0069568 | A1* | 3/2021 | Meadows | G06N 20/00 |
| 2021/0125349 | A1* | 4/2021 | Song | G01S 5/16 |

* cited by examiner

300

SYSTEM AND METHOD FOR A GOLF SUPER TAG MULTIFUNCTION GOLF SWING CAPTURE AND ANALYSIS DEVICE

PRIORITY CLAIMS

This application claims the benefit of U.S. Provisional Patent Application Ser. No. 63/279,576, filed Nov. 15, 2021, the contents of which are incorporated herein by reference.

BACKGROUND OF THE INVENTION

In order to optimize one's golf swing and golf game, data on the golf swing and round of play is critically important for the golfer and can be extremely beneficial both for training and on course play. A device that can accurately measure the dynamics of the golf club swing, sense the impact of club to golf ball, merge that data to geophysical location data on a golf course, determine bearing to intended target, display that data to a golfer and upload that data to web servers for post round analysis would be extremely helpful to the golfer.

SUMMARY OF THE INVENTION

The present invention is a Golf Super Tag multifunction golf swing capture and analysis device. In the preferred embodiment of the present invention, the device is comprised of a printed circuit board mounted in a case attached to the end of the club grip or mounted along the club shaft containing a combination of one or multiples of the following sensors and components but not limited to the following sensors and electronic components.

Accelerometer—to determine the acceleration along a vector in x, y and z directions. One or all axis' can be utilized.

Gyro—to determine the degrees per second of rotation about an axis in x, y and z orientations. One or all axis' can be utilized.

Magnetometer/Digital Compass—to determine device orientation to the earth's magnetic field Light sensor—to determine wake up states for the device Microcontroller—to integrate the data from the above components for onboard processing and/or transmission Memory—to store microcontroller firmware and sensor and identification data Bluetooth Low Energy radio—to transmit sensor data and receive data as needed from a paired device. Other RF or communications technologies can be utilized.

Optional components—Piezo sensor, tilt sensor for cost reduced "Simple Tag"

Battery—to power the components. Could be a primary Lithium Ion or any other battery technology or a rechargeable battery for the same purpose. An option to on board battery would be an "energy harvesting" circuit comprised of a combination but not limited to a super capacitor, piezo, Peltier and/or solar cell to power the unit.

Contains a unique ESN or ID. Typically a set of clubs would have 14 Super Tags each with it's own unique ESN or ID. This ESN or ID would be transmitted along with the respective sensor data.

The ESN or ID would be associated with a golf club description (Driver, 9 Iron, etc.) either on a paired device or written back into the tags on board memory.

Ruggedized plastic or composite case to contain PCB, components and battery that securely mounts to the end of golf club grip or along golf club shaft.

When the Super Tag is mounted to a golf club it will determine its position in or out of the golf bag. If it is out of the golf bag it then enters a state of waiting for a golf swing ID that can be associated with each golf club.

Once there is enough motion as determined by sensor data from the accelerometer and/or gyro and/or magnetometer the sensor data associated with the golf club swing is processed by the microcontroller firmware that analyzes the physics of the golf swing to determine the various characteristics of the golf swing such as swing plane, club face orientation, club head speed, point of ball impact, etc. This data can be stored in onboard memory and/or relayed via Bluetooth Low Energy or other communication protocols for storage, further application processing and/or relay to web based systems.

If the Super Tag is paired to a BLE (or other communications protocol) device such as a SkyCaddie that contains GPS—the golf swing data can be associated with geophysical information such as time stamp, latitude, longitude, etc. for overlay on to golf course imagery to show the golfer either in real time or post round analysis the location and dynamics of the golf shot at that particular time and location on the course.

One embodiment of the Super Tag would be to determine the intended and actual Bearing to Target via the function of magnetometer/digital compass sensor data. It is envisioned that the golf club would be pointed to the intended target on the golf course or otherwise oriented to indicate intended bearing to target. The magnetic field degrees to magnetic North would be captured and recorded in memory prior to the golf swing. The accelerometer and/or gyro data would compensate the orientation of the magnetometer to provide accurate magnetic compass degrees to the intended target. The geo-location of the ball strike is then captured along with any other associated sensor data of the golf swing.

Upon transit to the landing location of the golf ball the ball location can be marked and geo-tagged and/or geo-tagged upon the next club swing and ball strike.

The magnetic bearing to target data with reference to magnetic North would be translated to golf course imagery True North data via declination offset tables or algorithms and the vector of the golf ball flight and landing would be displayed in real time or post round analysis as it relates to the intended bearing to target. This would be beneficial to the golfer to help identify accuracy issues in golf swing and ball flight.

The firmware is comprised of code that runs on the microcontroller to handle the microcontroller startup, wake up, power management, sensor control and sensor data, as well as BlueTooth (or other communication protocols). It is also comprised of a physics engine that analyzes the sensor data to create a 3D profile of the swing, ball strike and follow through. This data and/or profile is transmitted to a SkyCaddie and/or other mobile device for logging, processing and display of the golf swing profile as well as geo-location of that data on the golf course. The ball strike and landing locations are also displayed on the course hole imagery along with the graphical vector data of the captured intended and actual bearing to target.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The various embodiments are illustrated by way of example, and not by way of limitation, in the figures of the accompanying drawings. Having thus described the invention in general terms, reference will now be made to the accompanying drawings, which are not necessarily drawn to scale, and wherein.

DETAILED DESCRIPTION OF THE PREFERRED EMBODIMENT

Figure 1:
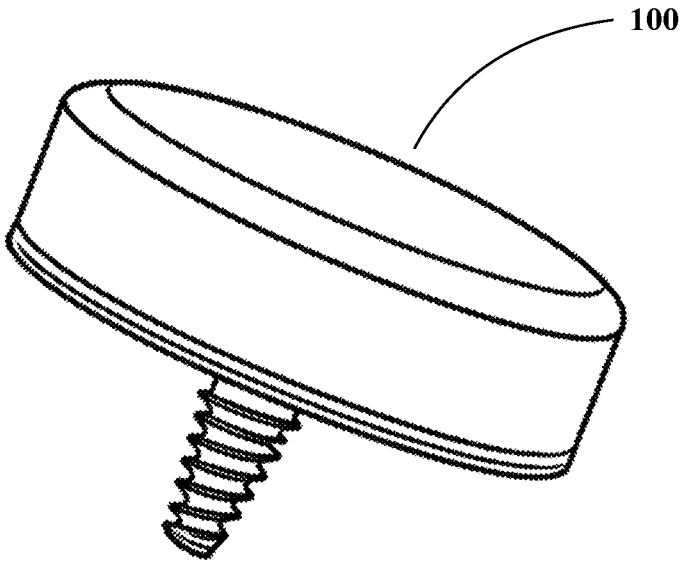
FIG. 1 is a drawing of the tag concept of the present invention.

FIG. 1 is a drawing of the tag concept of the present invention 100. In accordance with the preferred embodiment of the present invention, the device 100 is comprised of a printed circuit board mounted in a case attached to the end of the club grip or mounted along the club shaft containing a combination of one or multiples of the following sensors and components but not limited to the following sensors and electronic components.

Accelerometer—to determine the acceleration along a vector in x, y and z directions. One or all axis' can be utilized.

Gyro—to determine the degrees per second of rotation about an axis in x, y and z orientations. One or all axis' can be utilized.

Magnetometer/Digital Compass—to determine device orientation to the earth's magnetic field Light sensor—to determine wake up states for the device Microcontroller—to integrate the data from the above components for onboard processing and/or transmission Memory—to store microcontroller firmware and sensor and identification data Bluetooth Low Energy radio—to transmit sensor data and receive data as needed from a paired device. Other RF or communications technologies can be utilized.

Optional components—Piezo sensor, tilt sensor for cost reduced "Simple Tag"

Battery—to power the components. Could be a primary Lithium Ion or any other battery technology or a rechargeable battery for the same purpose. An option to on board battery would be an "energy harvesting" circuit comprised of a combination but not limited to a super capacitor, piezo, Peltier and/or solar cell to power the unit.

Contains a unique ESN or ID. Typically a set of clubs would have 14 SuperTags each with it's own unique ESN or ID. This ESN or ID would be transmitted along with the respective sensor data.

The ESN or ID would be associated with a golf club description (Driver, 9 Iron, etc.) either on a paired device or written back into the tags on board memory.

Ruggedized plastic or composite case to contain PCB, components and battery that securely mounts to the end of golf club grip or along golf club shaft.

Figure 2:
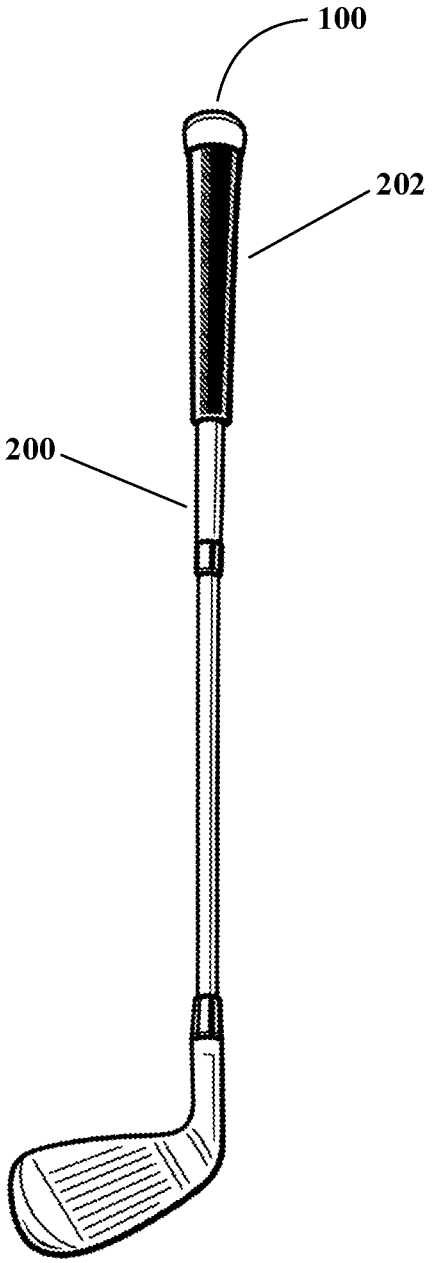
FIG. 2 is an image showing the placement of the tag on a club.

FIG. 2 is an image showing the placement of the tag 100 on a club 200. In accordance with the preferred embodiment of the present invention, the device 100 is comprised of a printed circuit board mounted in a case attached to the end of the club grip 202 or mounted along the club shaft. When the Super Tag 100 is mounted to a golf club 200 it will determine its position in or out of the golf bag. If it is out of the golf bag, it then enters a state of waiting for a golf swing ID that can be associated with each golf club.

Once there is enough motion as determined by sensor data from the accelerometer and/or gyro and/or magnetometer the sensor data associated with the golf club swing is processed by the microcontroller firmware that analyzes the physics of the golf swing to determine the various characteristics of the golf swing such as swing plane, club face orientation, club head speed, point of ball impact, etc. This data can be stored in onboard memory and/or relayed via Bluetooth Low Energy or other communication protocols for storage, further application processing and/or relay to web-based systems.

If the Super Tag is paired to a BLE (or other communications protocol) device such as a SkyCaddie that contains GPS—the golf swing data can be associated with geophysical information such as time stamp, latitude, longitude, etc. for overlay on to golf course imagery to show the golfer either in real time or post round analysis the location and dynamics of the golf shot at that particular time and location on the course.

Figure 3:
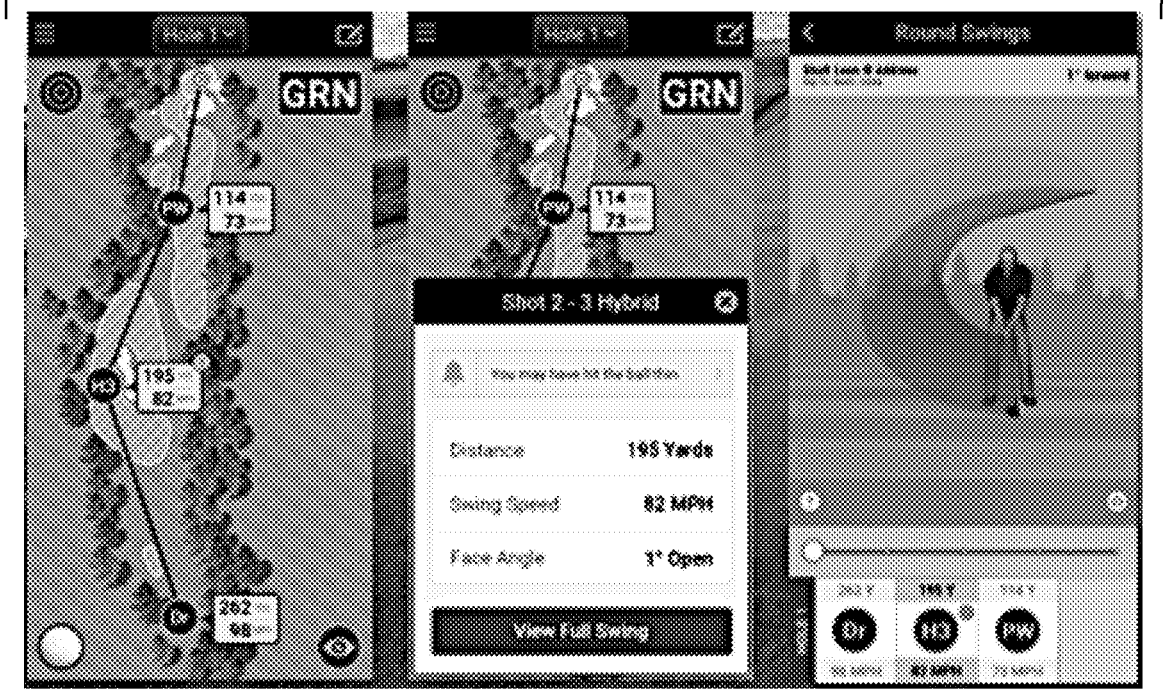
FIG. 3 is an image of the display showing tag geo-location data with swing analysis.

FIG. 3 is an image of the display showing tag geo-location data with swing analysis 300. One embodiment of the Super Tag would be to determine the intended and actual Bearing to Target via the function of magnetometer/digital compass sensor data. It is envisioned that the golf club would be pointed to the intended target on the golf course or otherwise oriented to indicate intended bearing to target. The magnetic field degrees to magnetic North would be captured and recorded in memory prior to the golf swing. The accelerometer and/or gyro data would compensate the orientation of the magnetometer to provide accurate magnetic compass degrees to the intended target. The geo-location of the ball strike is then captured along with any other associated sensor data of the golf swing. Upon transit to the landing location of the golf ball the ball location can be marked and geo-tagged and/or geo-tagged upon the next club swing and ball strike.

Figure 4:
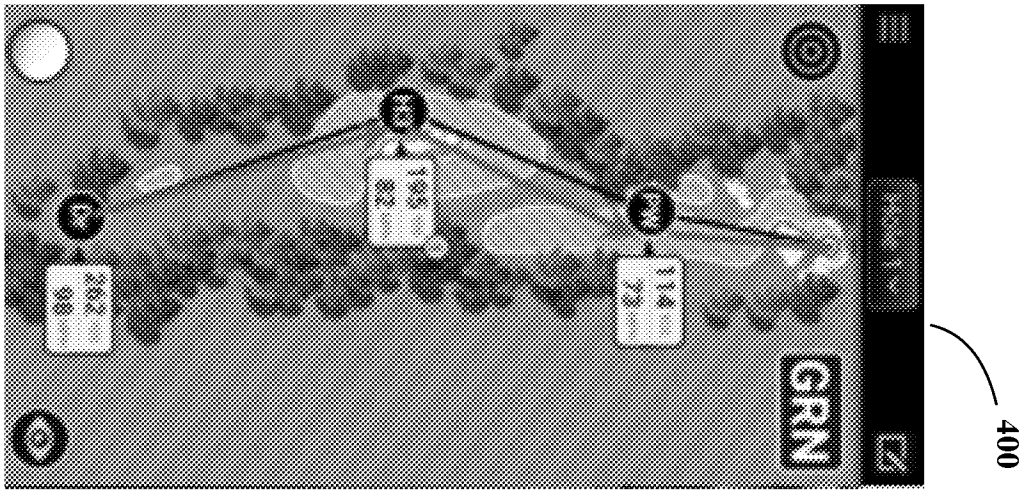
FIG. 4 is an image of the display showing the intended bearing to target vs. actual bearing to target.

FIG. 4 is an image of the display showing the intended bearing to target vs. actual bearing to target 400. In accordance with the preferred embodiment of the present invention, the magnetic bearing to target data with reference to magnetic North would be translated to golf course imagery True North data via declination offset tables or algorithms and the vector of the golf ball flight and landing would be displayed in real time or post round analysis as it relates to the intended bearing to target. This would be beneficial to the golfer to help identify accuracy issues in golf swing and ball flight.

The firmware is comprised of code that runs on the microcontroller to handle the microcontroller startup, wake up, power management, sensor control and sensor data, as well as Bluetooth (or other communication protocols). It is also comprised of a physics engine that analyzes the sensor data to create a 3D profile of the swing, ball strike and follow through. This data and/or profile is transmitted to a Sky-Caddie and/or other mobile device for logging, processing and display of the golf swing profile as well as geo-location of that data on the golf course. The ball strike and landing locations are also displayed on the course hole imagery along with the graphical vector data of the captured intended and actual bearing to target.

Figure 5:
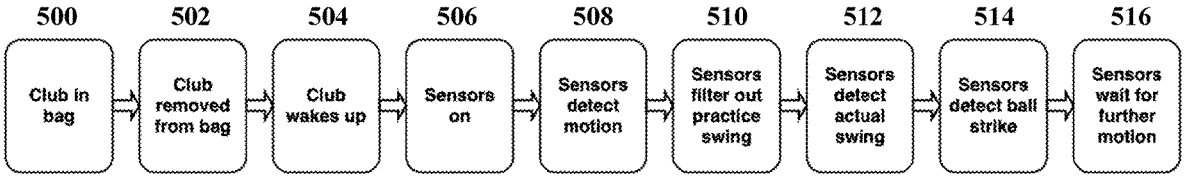
FIG. 5 is a flow diagram of the sensors of the present invention.

FIG. 5 is a flow diagram of the sensors of the present invention. In accordance with the preferred embodiment of the present invention, a golf club can be stored in a bag 500 when not in use. When the club is removed from the bag 502 it wakes up the sensors 504, which are turned on 506. The sensors detect motion 508 and can filter out practice swings 510. The sensors can detect the actual swing 512 and subsequent ball strike 514. The sensors then wait for further motion 516.

Figure 6:
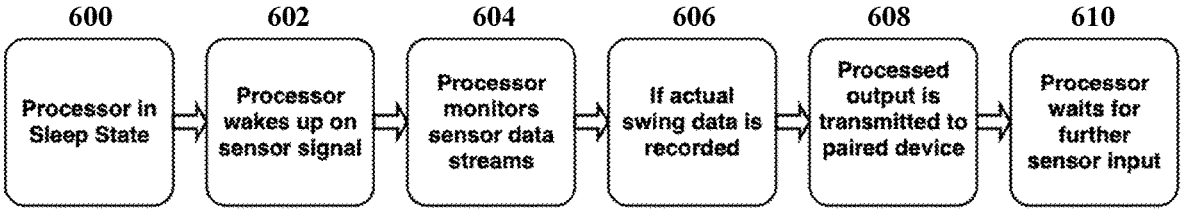
FIG. 6 is a flow diagram of the processor of the present invention.

FIG. 6 is a flow diagram of the processor of the present invention. In accordance with the preferred embodiment of the present invention, when the device is not in use, the processor is in a sleep state 600. The processor wakes up on the sensor signal 602. The processor monitors sensor data streams 604. If actual swing data is recorded 606, the processed output is transmitted to the paired device 608 and the processor waits for further sensor output 610.

Figure 7:
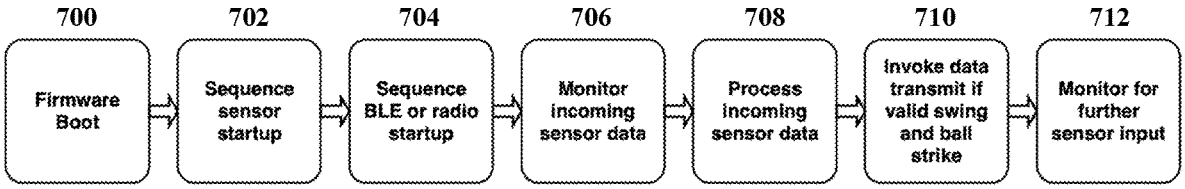
FIG. 7 is a flow diagram of the firmware of the present invention.

FIG. 7 is a flow diagram of the firmware of the present invention. In accordance with the preferred embodiment of the present invention, the firmware is booted 700 and the sequence sensors starts up 702, resulting in sequence Bluetooth Low Energy (BLE) or radio startup 704. Incoming sensor data is monitored 706 and any incoming sensor data is processed 708. Data transmission is invoked if there is a valid swing and ball strike detected 710. The firmware then monitors for further sensor input 712.

Figure 8:
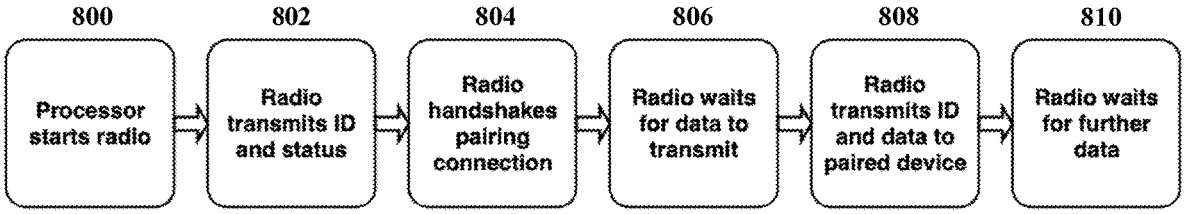
FIG. 8 is a flow diagram of the Bluetooth and radio communication of the present invention.

FIG. 8 is a flow diagram of the Bluetooth and radio communication of the present invention. In accordance with the preferred embodiment of the present invention, the processor starts the radio 800, which then transmits the ID and status 802. The radio handshakes the pairing connection 804 and then waits for data to transmit 806. Radio transmits the ID and data to the paired device 808, and then the radio waits for further data 810.

Figure 9:
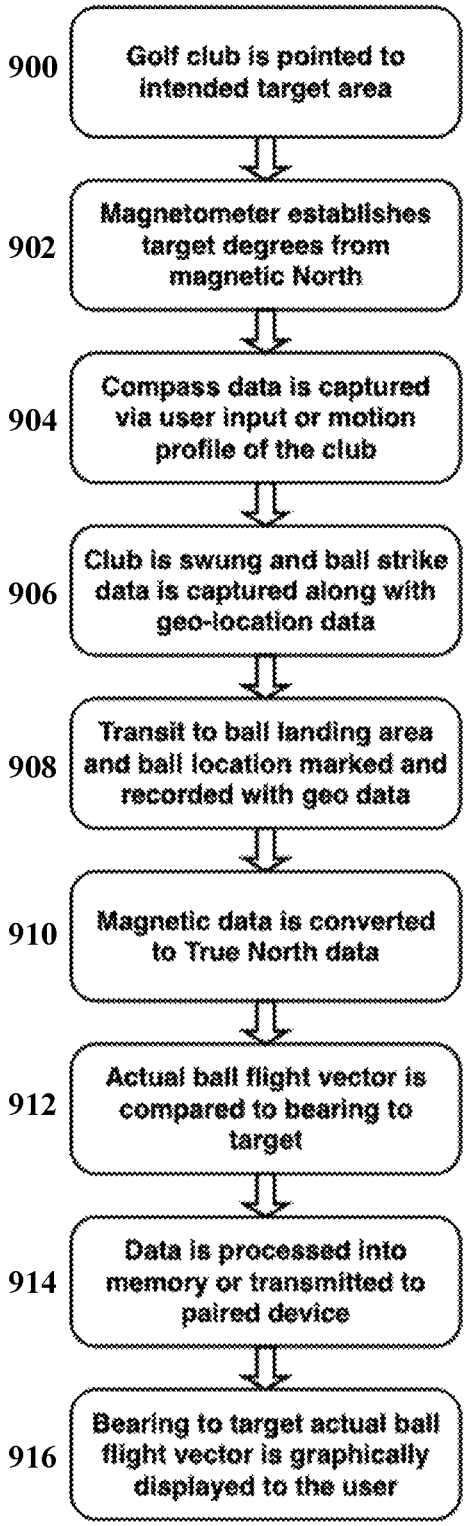
FIG. 9 is a flow diagram of the bearing to target of the present invention.

FIG. 9 is a flow diagram of the bearing to target of the present invention. In accordance with the preferred embodiment of the present invention, when the golf club is pointed to the intended target area 900, the magnetometer establishes target degrees from magnetic North 902. Compass data is captured via user input or the motion profile of the club 904. When the club is swung, the ball strike data is captured along with the geolocation data 906. The transit to the ball landing area and ball location are marked and recorded with geolocation data 908. Magnetic data is then converted to True North data 910. The actual ball flight vector is compared to bearing to target 912. Data is processed into memory or transmitted to paired device 914, and the bearing to target and actual ball flight vector is graphically displayed to the user 916.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that may be included in the disclosed technology. The disclosed technology is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the technology disclosed herein. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

What is claimed is:

1. A device comprising of:

a single or multiple combination of sensors that attaches to a golf club to determine golf club orientation and motion dynamics, wherein said sensors determine acceleration, rotation and deceleration of said golf club, and wherein said sensors are further comprised of a light sensor that determines a wake up state for said device wherein said wake up state is determined by physical state of said golf club outside of an enclosed golf bag, and wherein said sensors can detect motion and filter out practice swings from a valid swing, wherein said valid swing is determined by ball strike detection by said single or multiple combination of sensors, such that data is only transmitted to a processor when the valid swing occurs;

a processor for processing sensor data that includes a processing unit to integrate sensor data and apply firmware algorithms to the data to output 3D club motion dynamics, wherein said processor executes a physics engine configured to generate a 3D profile of said golf club orientation and motion dynamics, for real-time analysis, and wherein said processor operates under at least one of a sleep state or said wake up state, and wherein said processor wakes from said sleep state in response to a signal from said light sensor;

an identification tag associating the golf club it is mounted on with a golf club description written to a paired device or back into tags on a board memory such that once the wake up state of the golf club is intiated the identification tag is transmitted to the processor, sensing which club is in use at any given time;

a magnetometer as a digital compass to determine intended bearing to target on a golf course and to store that data for reference to actual bearing to target, wherein said device is configured to generate and display a graphical overlay on course imagery, via declination offset or algorithms, depicting said intended bearing to target and an actual ball flight vector for analysis;

memory to store and forward raw and processed sensor data to a paired device;

a mounting mechanism to prevent rotation of the device; and a ruggedized plastic composite case to contain all components of the device.

2. A device according to claim 1 that derives an actual golf ball strike from sensor data.

3. A device according to claim 1 that derives a practice swing from sensor data.

4. A device according to claim 1 that uses sensor data to manage power states.

5. A device according to claim 1 that allows for playing a virtual round of golf on said golf course by processing sensor data.

6. A device according to claim 1 that allows for playing a virtual round of golf apart from said golf course by processing sensor data.

7. A device according to claim 1 that provides sensor data input to a geo-location device.

8. A device according to claim 1 that provides a unique unit ID for integration with sensor data, wherein said sensor data is transmitted with a unique unit ID to said paired device.

9. A device according to claim 1 that allows for user input to indicate intended bearing to target.

10. A device according to claim 1 that allows for passive input via motion capture to indicate intended bearing to target.

11. A device according to claim 1 that allows for calibration of the sensor, configured as a sensor tag, to club face orientation, wherein said calibration of the sensor tag can determine club face angle at golf ball impact.

12. A device according to claim 1 that uses machine learning to determine and optimize motion capture dynamics unique to a user.

13. A device according to claim 1 that can provide real time feedback to a user for club position, orientation and/or swing timing.

14. A device according to claim 1 that can utilize energy harvesting to provide voltage for sensors and transmission of sensor data.

15. A method utilizing single or multiple combination of sensors that attaches to a golf club to determine golf club orientation and motion dynamics, wherein said sensors determine acceleration, rotation and deceleration of said golf club, and valid swings determined by ball strike detection thereby filtering out practice swings, and comprising of:

a magnetometer as a digital compasss to determine intended bearing to target on a golf course and to store that data for reference to actual bearing to target, and generating and displaying a graphical overlay on course imagery, via declination offset or algorithms, depicting said intended bearing to target and an actual ball flight vector for analysis;

a processor for processing sensor data that includes a processing unit to integrate sensor data and apply firmware algorithms to the data to output 3D club motion dynamics, wherein said processor executes a physics engine configured to generate a 3D profile of said golf club orientation and motion dynamics, for real-time analysis, and wherein said processor operates under at least one of a sleep state or a wake up state, and wherein a light sensor determines said wake up state for said processor, and wherein said processor wakes from said sleep state in response to a signal from said light sensor;

an identification tag associating the golf club it is mounted on with a golf club description written to a paired device or back into tags on a board memory such that once the wake up state of the golf club is intiated the identification tag is transmitted to the processor, sensing which club is in use at any given time;

memory to store and forward raw and processed sensor data to a paired device; and a mounting mechanism to prevent rotation of the device.

16. A method according to claim 15 that derives an actual golf ball strike from sensor data.

17. A method according to claim 15 that derives a practice swing from sensor data.

18. A method according to claim 15 that uses sensor data to manage power states.

19. A method according to claim 15 that allows for playing a virtual round of golf on said golf course by processing sensor data.

20. A method according to claim 15 that allows for playing a virtual round of golf apart from said golf course by processing sensor data.

21. A method according to claim 15 that provides sensor data input to a geo-location device.

22. A method according to claim 15 that provides a unique unit ID for integration with sensor data, wherein said sensor data is transmitted with a unique unit ID to said paired device.

23. A method according to claim 15 that allows for user input to indicate intended bearing to target.

24. A method according to claim 15 that allows for passive input via motion capture to indicate intended bearing to target.

25. A method according to claim 15 that allows for calibration of the sensor, configured as a sensor tag, to club face orientation, wherein said calibration of the sensor tag can determine club face angle at golf ball impact.

26. A method according to claim 15 that uses machine learning to determine and optimize motion capture dynamics unique to a user.

27. A method according to claim 15 that can provide real time feedback to a user for club position, orientation and/or swing timing.

28. A method according to claim 15 that can utilize energy harvesting to provide voltage for sensors and transmission of sensor data.

29. A method according to claim 15 to filter and extract only pertinent data from the sensors.

* * * * *